US005263836A

United States Patent [19]

Tinawong

[11] Patent Number: 5,263,836

[45] Date of Patent: Nov. 23, 1993

[54] TOOL FOR APPLYING ADHESIVE TO A TAPED JOINT OF CONVERGING DRYWALL SECTIONS

[76] Inventor: Savat Tinawong, 6701 N. Tryon St., Charlotte, N.C. 28213

[21] Appl. No.: 7,516

[22] Filed: Jan. 22, 1993

[51] Int. Cl.[5] ..... B05C 17/10

[52] U.S. Cl. ..... 425/87; 15/235.7; 15/235.8; 425/458

[58] Field of Search ..... 425/87, 458; 249/DIG. 6; 15/235.4, 235.5, 235.7, 235.8

[56] References Cited

U.S. PATENT DOCUMENTS

| | | | |
|---|---|---|---|
| 2,824,443 | 2/1958 | Ames | 425/87 |
| 3,056,159 | 10/1962 | Hoveland | 15/235.7 |
| 3,932,101 | 1/1976 | Johnson et al. | 425/458 |
| 4,116,604 | 9/1978 | Johnson et al. | 425/458 |
| 4,451,223 | 5/1984 | Mower et al. | 425/458 |
| 4,767,297 | 8/1988 | Mower et al. | 425/87 |
| 5,010,618 | 4/1991 | Croft | 15/235.7 |

*Primary Examiner*—David A. Simmons
*Assistant Examiner*—William J. Matney, Jr.
*Attorney, Agent, or Firm*—Shefte, Pinckney & Sawyer

[57] ABSTRACT

An adhesive distribution control tool is provided for controlling the flow adhesive onto a tape joint of converging drywall sections. The tool includes a pair of flow regulating portions, each for regulating the flow of adhesive onto a lateral half of a taped joint and each flow regulating portion has a raised surface and a cavity recessed from the raised surface through which adhesive flows to adhere to the taped joint. Also, the tool includes an adhesive flow control device mounted at the vertice of the angle formed by the pair of the flow regulating portions which regulates the flow of adhesive cut of the cavities onto the taped joint. The adhesive flow control device includes a pair of angled members laterally interposed between the cavities and the taped joint which deflect the adhesive flowing out of the cavities and insure proper distribution on the taped joints.

7 Claims, 3 Drawing Sheets

TOOL FOR APPLYING ADHESIVE TO A TAPED JOINT OF CONVERGING DRYWALL SECTIONS

BACKGROUND OF THE INVENTION

The present invention relates to an improved tool for applying adhesive to the taped joint of converging drywall sections and, more particularly, to an improved tool for insuring uniform application of a proportionate amount of adhesive to a taped joint of converging drywall sections.

Drywall sections are typically installed on wood or metal framing to form the finished walls and ceiling of a room or other enclosure. At the junction of two converging walls or a converging wall and ceiling, the drywall sections forming the two respective converging finished surfaces are dimensioned such that the adjacent edges of the complementary converging sections are in a relatively close, substantially abutting relationship with one another. Nonetheless, a narrow gap typically still remains between the converging drywall sections, and for this reason, as well as for other reasons such as the desire to provide a substantially seamless surface along the interior surfaces of the room or the enclosure, it is common practice to adhesively apply a length of tape along the converging drywall sections which overlaps the complementary converging surfaces. The tape adhesive is formulated such that, when it dries, the tape provides a smooth surface which is effectively a continuation of the surfaces of the complementary converging drywall sections. The taped joints, as they are called, therefore present smooth surfaces for accepting the paint or wallpaper which is ultimately applied to the interior surface of the drywall sections.

The tape applied to drywall joints is typically a porous, paper-based tape through which the tape adhesive can migrate or can be forced under pressure. During the process of adhering the tape along a drywall joint, the adhesive not only adheres the tape to the underlying drywall surface, but ultimately covers the tape in a coating. Moreover, through attention to the distribution and the amount of the adhesive applied to the tape, a functionally and aesthetically desirable smooth coating of the adhesive on the tape can be achieved so as to make the joint appear to be effectively a seamless continuation of the converging drywall sections.

Several commercially available devices are available for applying adhesive and tape to drywall joints. For example, U.S. Pat. No. 4,828,647 to Eccleston discloses a taping apparatus for applying tape and adhesive to a (co-planar) joint formed by adjoining drywall sections. Additionally, specialized tools are available for facilitating the process of providing a smooth finish on the taped joint. For example, U.S. Pat. No. 4,946,360 to Brown discloses a finishing tool for such purposes and U.S. Pat. No. 4,784,598 to Cranz et al, as well, discloses a tool for use in the drywall taping process.

However, even with tools which increase drywall installation efficiency by facilitating the supply of tape and adhesive or which facilitate the smooth finishing of a taped joint, the need still exists for tools which even further improve the efficiency of drywall installation. For example, the need still exists for a tool which reduces the number of "passes", or smoothing strokes, which must be performed on an adhesive-moisten tape to ultimately achieve a proportioned coating of adhesive on the tape which, when dry, will provide a smooth surface, in combination with the tape.

SUMMARY OF THE INVENTION

Briefly described, the present invention provides, in one aspect thereof, a device for controlling the flow of adhesive from the tool onto the length of tape in a tool for regulating the distribution of adhesive along a taped joint of the type formed by the junction of a pair of converging drywall sections and having a length of tape disposed on the junction. The device is operable on a tool having a pair of flow regulating portions each extending from the vertice of an angle formed between the flow regulating portions and each having a raised surface for distributing and smoothing adhesive along the length of tape during movement of the tool along the joint and an open top cavity recessed laterally inwardly of the raised surface and communicated with the cavity of the other flow regulating portion at the angle vertice and the tool having an opening communicated with both cavities at the angle vertice through which adhesive is supplied contemporaneously with the movement of the tool along the joint, such that the adhesive flows from the opening into both cavities and through the open tops of the cavities onto the length of tape.

The device includes a first member extending at least partially across the open top of one of the cavities for deflecting adhesive flowing laterally from the one cavity through the open top thereof and a second member extending at least partially across the open top of the other cavity, for deflecting adhesive flowing laterally out of the other cavity, the first and second members forming a space therebetween through which adhesive flows.

Preferably, the first member includes an angled portion extending at an acute angle relative to a plane bisecting the angle formed by the flow regulating portions.

According to another feature of the one aspect of the present invention, the angled portion of the first member diverges outward relative to the direction of movement of the tool along the joint. Also, the second member preferably includes an angled portion forming an acute angle with the bisecting plane and diverging outwardly relative to the direction of movement of the tool along the joint.

According to further features of the one aspect of the present invention, the junction of the cavities of the pair of flow regulating portions along the angle vertice has a predetermined extent relative to the angle vertice and the first and second members are at least co-extensive with the predetermined extent of the junction of the flow regulating portions as measured along the angle vertice. Also, the tool preferably includes a threaded bore and further comprising a throughbore and a bolt for insertion through the throughbore into threading engagement with the threaded bore of the tool for securing the device to the tool.

According to another aspect of the present invention, there is provided a tool for regulating the distribution of adhesive along a taped joint of the type formed by the junction of a pair of converging drywall sections and having a length of tape disposed on the junction. The tool includes a pair of flow regulating portions each extending from the vertice of an angle formed between the flow regulating portions and each having a raised surface for distributing and smoothing adhesive along the length of tape during movement of the tool along the joint and an open top cavity recessed laterally inwardly of the raised surface and communicated with the cavity of the other flow regulating portion at the angle vertice. Also, the tool includes an opening communicated with both cavities at the angle vertice through which adhesive is supplied contemporaneously with the movement of the tool along the joint, such that the adhesive flows from the opening into both cavities and through the open tops of the cavities onto the length of tape. Furthermore, the tool includes a device for controlling the flow of adhesive from the tool onto the length of tape including a first member extending at least partially across the open top of one of the cavities for deflecting adhesive flowing laterally from the one cavity through the open top thereof and a second member extending at least partially across the open top of the other cavity for deflecting adhesive flowing laterally out of the other cavity, the first and second members forming a space therebetween through which adhesive flows.

DESCRIPTION OF THE PREFERRED EMBODIMENT

As seen in FIGS. 1–4, the preferred embodiment of the adhesive distribution control tool 10 is illustrated. The adhesive distribution control tool 10 is particularly adapted for controlling the distribution of drywall or other mastic-type adhesives during the application thereof to joint areas formed by converging surfaces such as, for example, converging drywall sections.

Figure 1:
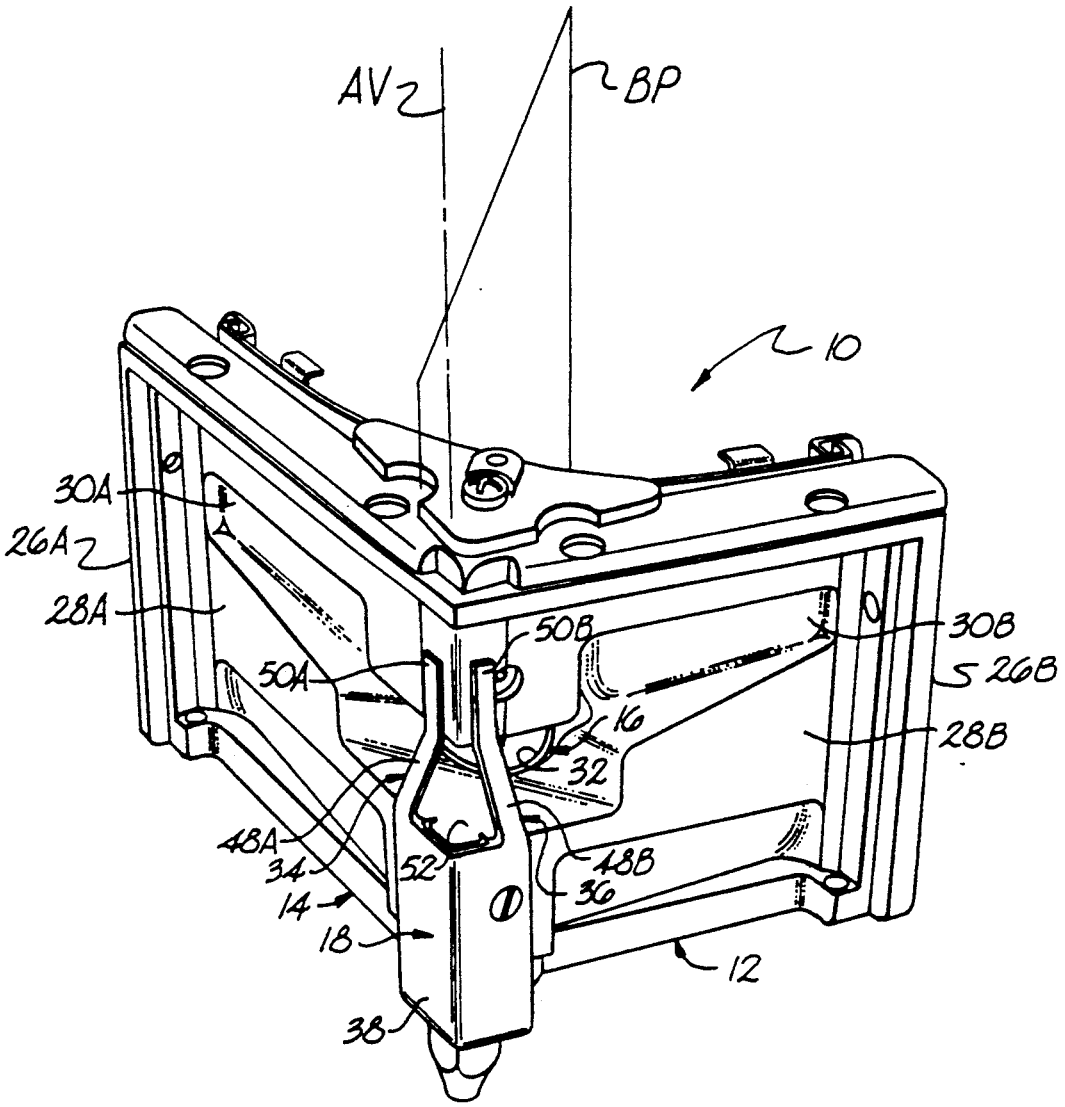
FIG. 1 is a perspective view of the preferred embodiment of the adhesive distribution control tool of the present invention showing the flow regulating device in its installed position thereon.
Figure 2:
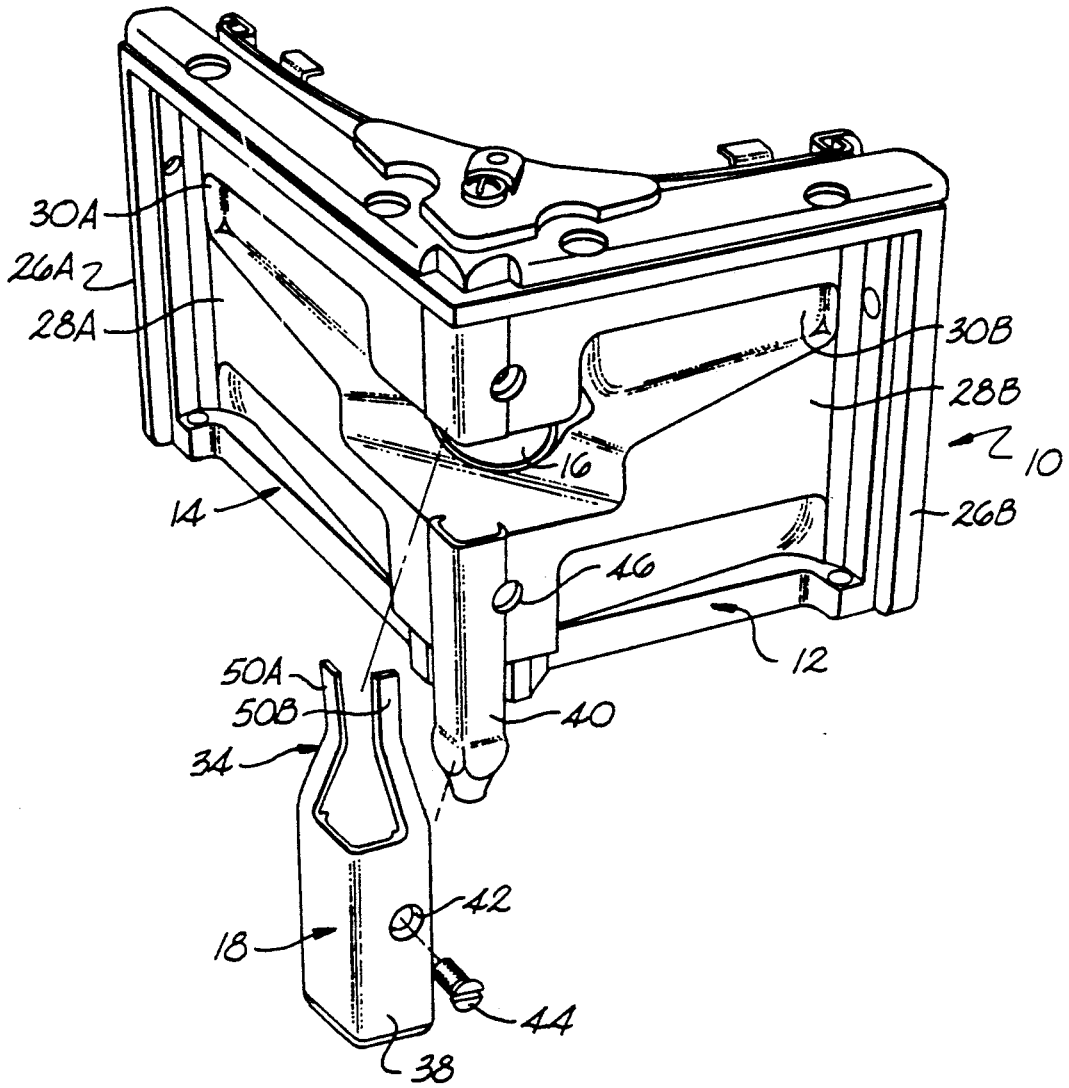
FIG. 2 is a perspective view of the adhesive distribution control tool shown in FIG. 1 and showing the flow regulating device in a non-installed position.

As seen in particular in FIGS. 1 and 2, the adhesive distribution control tool 10 includes a pair of flow regulating portions 12,14, an adhesive supply opening 16, and an adhesive flow control device 18. Each flow regulating portion 12,14 includes a raised surface for distributing and smoothing adhesive along a joint area 24 such as is exemplarily illustrated in FIG. 4, in which it can be seen that a wall drywall section 20 converges with a ceiling drywall section 22 to form the joint area 24. The flow regulating portions 12,14 each extend from the vertice AV of the angle formed between the pair of portions, which is preferably a substantially right angle.

The raised surface of each flow regulating portion 12,14 preferably includes a plow section 26A,26B, respectively, and a surface facing section 28A,28B, respectively. Each plow section 26A,26B is formed of a right angled member which extends laterally beyond the remainder of the respective flow regulating portion 14,16 for scraping contact of the plow section in the joint area 24, as described in more detail below, to "plow" or push adhesive in the joint area. Preferably, each right angled member of the plow sections 26A,26B is resiliently hingedly to a respective surface facing section 28A,28B for resilient lateral movement, as will be described in more detail below.

Each surface facing portion 28A,28B includes a smooth, laterally facing surface which is laterally recessed from the respective plow section 28A,28B. A cavity 30A,30B is formed in each surface facing section 28A,28B and is recessed inwardly from the smooth surface thereof such that the open top of the cavity is co-planar with the smooth surface of the surface facing section.

Each cavity 30A,30B is communicated with the other cavity at the vertice AV. The adhesive supply opening 16 is formed by an open top cup 32 whose open top opens into the cavities 30A,30B. The cup 32 is secured to the adhesive distribution control tool 10 at an orientation in which the annular open top of the cup is transversely bisected by a bisector plane BP which bi-sects the angle formed by the pair of the flow regulating portions 12,14 and in which the vertice AV lies.

To the extent that the adhesive distributer control tool 10 comprises the pair of the flow regulating portions 12 14, several configurations of the tool are commercially available and one such commercially available model is sold by Premier Drywall Tool Company of Belmont, Calif.

The adhesive flow control device 18 is preferably formed of a single piece of molded or stamped metal or alloy and includes a first member 34 and a second member 36 both integrally formed with, and extending from, a mounting portion 38. The mounting portion 38 has a right angled shape formed in conformance with the structure of the adhesive distribution control tool 10 in the area of its vertice AV. For example, if the adhesive distribution control tool 10 includes a right angled corner post 40, such as seen in FIG. 2, the mounting portion 38 is formed of a right angled shape for conformed mounting to the post. The mounting portion 38 preferably includes a throughbore 42, as seen in FIG. 2, through which a mounting bolt 44 is inserted for threading into a threaded bore 46 of the flow regulating portion 12.

As seen in FIG. 1, in the mounted position of the adhesive flow control device 18 on the corner post 40, the first member 34 extends completely across the open top of the cavity 30A for deflecting adhesive flowing laterally outwardly of the cavity and the second member 36 extends completely transversely across the open top of the cavity 30B for deflecting adhesive flowing laterally from the cavity. The first member 34 includes an angled portion 48A which forms an acute angle with the bisector plane BP and diverges in the direction of movement of the adhesive distribution control tool 10 along the joint area 24. The first member 34 also includes an end portion 50A extending from the angled portion 48A which extends generally parallel to the vertice AV.

The second member 36 includes an angled portion 48B forming an acute angle with the bisector plane BP and diverging therefrom in the direction of movement of the adhesive distribution control tool 10 along the joint area 24. The second member 36 also includes an end portion 50B extending from the angled portion 48B generally parallel to the vertice of AV. The first member 34 and the second member 36 form therebetween a space 52 substantially bisected by the bisector plane BP through which adhesive flows. Thus, as can be seen in FIG. 1, adhesive applied through the adhesive supply opening 16 flows into the cavities 30A 30B and flows laterally outwardly toward the joint area 24 through the open top of the cavities and through the space 52.

The lateral thickness of the first member 34 and the second member 36 is selected such that the surface of the member laterally facing the joint area 24 is recessed laterally inwardly from the respective plow section 26A,26B so as not to interfere with the plowing operation of these plow sections, as will be described in more detail below.

Figure 4:
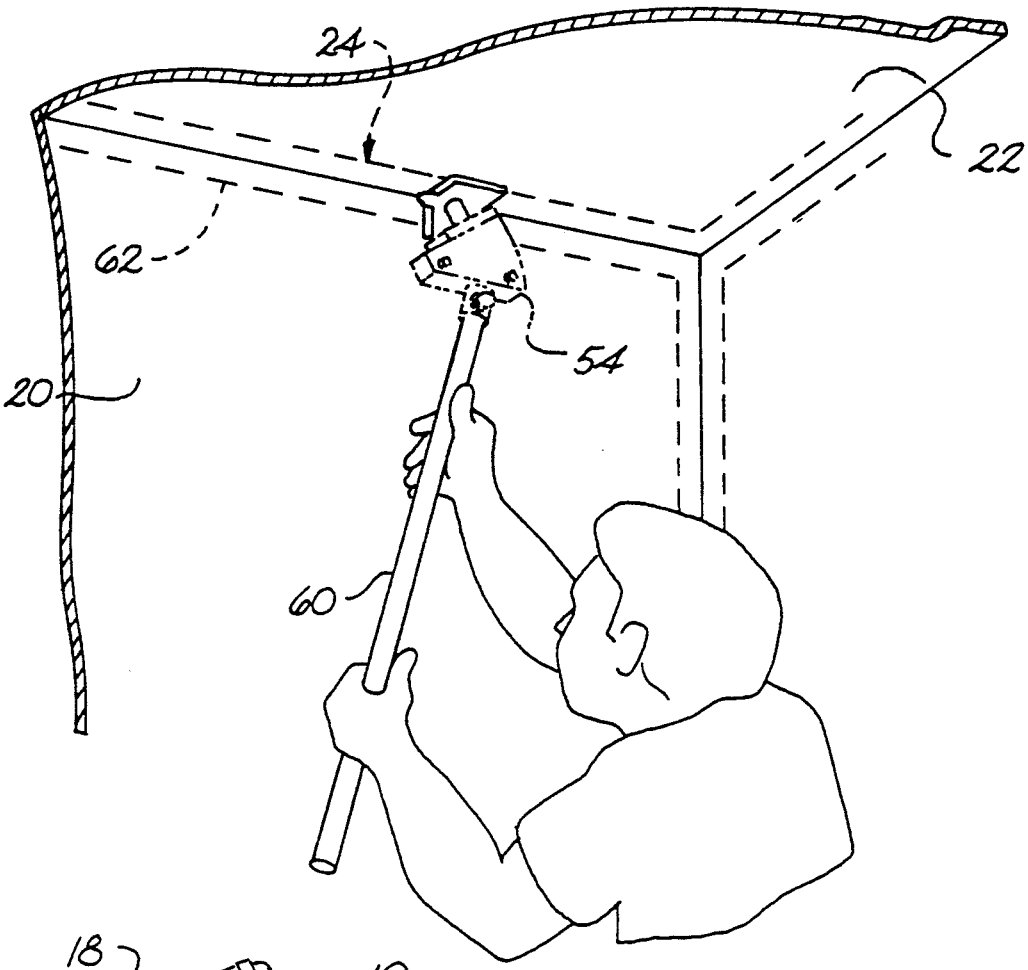
FIG. 4 is a perspective view of an assembly including the adhesive distribution control tool of the present invention, the adhesive dispensing unit, and a handle for use of the tool by an operator in applying adhesive to a taped joint of convergent drywall sections.
Figure 3:
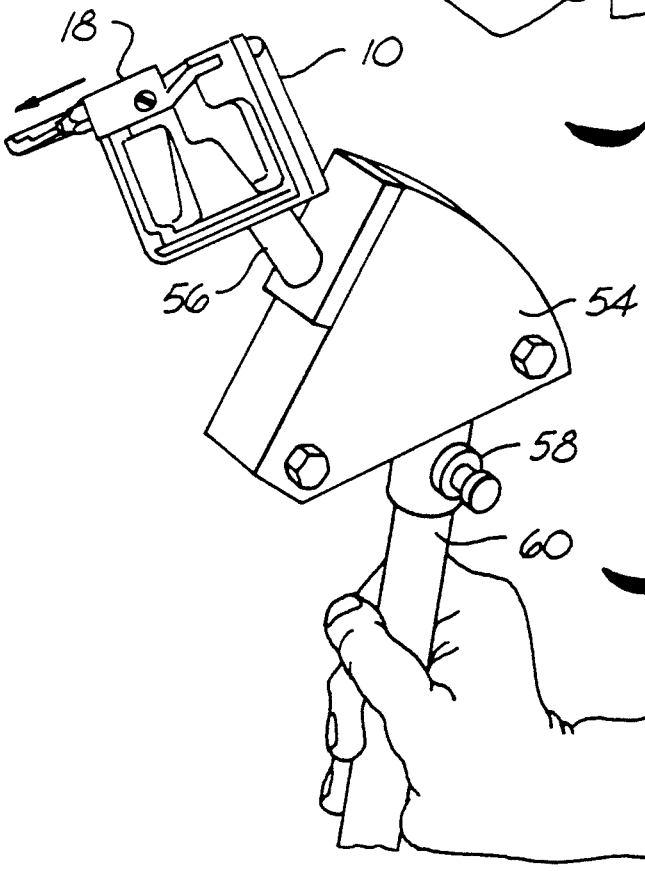
FIG. 3 is a perspective of the adhesive distribution control tool of the present invention mounted on a handle-mounted adhesive dispensing unit.

As seen in FIGS. 3 and 4, in operation, the adhesive distribution control tool 10 is connected to a supply of adhesive for continuous feed of adhesive into the cavities 30A,30B for application onto the joint area 24. As seen in FIG. 3, a supply of adhesive to the adhesive distribution control tool 10 can be provided by a conventional "corner box" adhesive dispensing unit 54 which includes an adhesive storage chamber into which adhesive has been introduced under pressure and an outlet conduit 56 extending from the adhesive storage chamber and sealingly communicated with the cup 32 for introducing adhesive from the adhesive storage chamber through the adhesive supply opening 16. The adhesive dispensing unit 54 is fixedly mounted via a mounting assembly 58 to a handle 60.

As seen in FIG. 4, an operator can manipulate the adhesive distribution control tool 10 along the joint area 24 by grasping and moving the handle 60. Before positioning the adhesive distribution control tool 10 at the joint area 24, the operator fills the adhesive dispensing u it 54 with a load of adhesive such that adhesive is continually urged through the outlet conduit 56 due to its pressurized condition with the adhesive dispensing unit 54. Also, prior to the use of the adhesive distribution control tool 10, the operator installs a length of tape 62 along the joint area 24 during a tape installation step. The tape 62 is typically a paper-based, porous tape which permits migration of adhesive therethrough. The tape 62 is disposed along the joint area 24 such that one lateral half of the tape extends over the edge portion of the wall drywall section 20 and the other lateral half of the tape extends over an edge portion of the ceiling drywall section 22.

During the tape installing step, the tape 62 is initially disposed on the joint area 24 after an amount of adhesive has been applied to the joint area itself as well as to the tape 62. The tape 62 is then pressed into the joint area 24 by, for example, a rolling operation in which a roller (not shown) is rolled along the tape. While the adhesive applied during this tape installation step typically has sufficient adhesion strength to insure that the tape 62 adhers to the joint area 24, a situation sometimes occurs in which it is desirable to apply additional adhesive to the tape 62 to insure that the finish ultimately provided by the dried adhesive and the tape will be a smooth and continuous finish. For example, the wall drywall section 20 and the ceiling drywall section 22 may not be disposed in relatively close, edge-abutting relation to one another such that a relatively substantial gap exists between the adjacent edge portions of these drywall sections and, if this occurs, adhesive which has been applied in the joint area 24 during the tape installing step may not adequately "bridge" the gap or may even be forced through the gap during the rolling operation in which the tape is rolled.

In those situations in which additional adhesive is necessary or desired, the adhesive dispensing unit 54 is loaded with adhesive and the operator raises the adhesive distribution control tool 10 to the joint area 24 with the tool being oriented such that the mounting portion 38 of the adhesive flow control device 18 is at the leading edge of the tool relative to its direction of movement along the joint area 24 and with the plow sections 26A,26B each in pressing contact with the respective lateral half of the tape 62 between the adhesive distribution control 10 and the drywall sections 20,22. The operator then manipulates the handle 60 to move the adhesive distribution control tool 10 along the tape 62 while continuously maintaining the plow sections 26A,26B in pressing contact with the tape 62 such that these plow sections "plow" or scrape adhesive on the outward side of the tape 62.

Simultaneously with the movement of the adhesive distribution control tool 10 along the tape 62, adhesive flows from the adhesive dispensing unit 54 through the outlet conduit 56 and into the cavities 30A,30B. As the adhesive flows along the cavities 30A,30B, the adhesive moves laterally out of the cavities through the open tops thereof and adheres to the tape 62. The plow sections 26A,26B scrape the adhesive almost immediately after it has flowed out of the cavities 30A,30B to thereby evenly distribute the adhesive over the tape 62 and remove excess adhesive therefrom.

The adhesive supply to the adhesive distribution control tool 10 also flows through the space 52 formed between the first member 34 and the second member 36 onto the laterally central portion of the tape 62. The first member 34 and the second member 36, which are laterally interposed between the cavities 30A,30B and the tape 62, deflect the adhesive to both sides of the respective member to flow out the open top of the cavities or out of the space 52. The adhesive flow control device 18 insures that the adhesive flowing laterally out of the cavities 30A,30B does not exit the cavities in an uneven or disproportionately non-uniform manner such as, for example, a manner in which too large a percentage of the adhesive being supplied through the adhesive supply opening 16 flows immediately laterally outwardly from the cavities 30A,30B in the region in which the cavities are communicated instead of flowing along the cavities outwardly away from the vertice AV before ultimately flowing laterally outward through the open top of the cavity onto the tape 62.

While the success of the adhesive control device 18 in controlling the flow of adhesive varies according to factors such as the viscosity of the adhesive and its flow characteristics, the adhesive flow control device 18 makes it possible in many situations for an operator to apply an extra or "glazing" coat of adhesive to the tape 62 without the necessity of performing an additional finishing step or separate "pass" in which the operator manipulates a finishing tool or blade along the tape 62 to evenly distribute adhesive and remove excess adhesive. Instead, due to the flow control provided by the adhesive flow control device 18, it is possible for an operator to apply the extra or "glazing" adhesive coating with only a single "pass" (e.g., a unidirectional movement of the adhesive distribution control tool 10 along the tape 62). The ability to apply such an extra "glazing" coat with the reduced manual labor afforded by the adhesive distribution control 10 results in a cost savings to the drywall installer or finisher.

Although the preferred embodiment of the adhesive distribution control tool 10 has been described as having an adhesive flow control device 18 formed of a single metal or alloy component, the present invention also contemplates that the adhesive flow control device 18 can be formed of other suitable material such as, for example, a suitably rigid polyvinylchloride (PVC) material. Also, the present invention contemplates that the orientation and geometry of the first member 34 and the second member 36 can be varied so as to optimize the flow control characteristics of the adhesive flow control device 18. For example, the angled portion 48A of the first member 34 or the angled portion 48B of the second member 36 can be eliminated and, instead, the respective member can be formed with an extent across the open top of the respective cavity 30A,30B which extends parallel to the bisector plane BP. While the details of the mechanism by which the adhesive flow control device 18 controls the flow of adhesive are not completely understood, it is believed that the fact that the first member 34 and the second member 36 are laterally interposed between their respective cavities 30A,30B and the tape 62 causes movement of the adhesive along the cavities in such a manner that, as the adhesive exits the cavities, a desirable distribution of the adhesive on the tape 62 occurs which ultimately leads to a smooth finish coating on the tape 62 upon drying of the adhesive applied by the adhesive distribution control tool 10 to the tape 62.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a tool for regulating the distribution of adhesive along a taped joint of the type formed by the junction of a pair of converging drywall sections and having a length of tape disposed on the junction, the tool having a pair of flow regulating portions each extending from the vertice of an angle formed between the flow regulating portions and each having a raised surface for distributing and smoothing adhesive along the length of tape during movement of the tool along the joint and an open top cavity recessed laterally inwardly of the raised surface and communicated with the cavity of the other flow regulating portion at the angle vertice and the tool having an adhesive supply opening communicated with both cavities at the angle vertice through which adhesive is supplied contemporaneously with the movement of the tool along the joint, such that the adhesive flows from the adhesive supply opening into both cavities and through the open tops of the cavities onto the length of tape, a device for controlling the flow of adhesive from the tool onto the length of tape, comprising:

a first member extending at least partially across the open top of one of the cavities in spaced relation to the adhesive supply opening for deflecting adhesive flowing laterally from the one cavity through the open top thereof; and a second member extending at least partially across the open top of the other cavity in spaced relation to the adhesive supply opening for deflecting adhesive flowing laterally out of the other cavity, the first and second members having the vertice of the angle therebetween and each said member being of a predetermined thickness to define a flow channel therebetween for accumulating a predetermined volume of the deflected adhesive and directing the delivery of the adhesive in a defined flow pattern to the drywall responsive to movement of the tool.

2. In a tool for regulating distribution of adhesive, a device according to claim 1 wherein the first member includes an angled portion extending inwardly toward the vertice of the angle formed by the flow regulating portions.

3. In a tool for effecting distribution of adhesive, a device according to claim 2 wherein the angled portion of the first member diverges into generally parallel relation with the direction of movement of the tool along the joint to further define said flow channel.

4. In a tool for effecting the distribution of adhesive, a device according to claim 3 wherein the second member includes an angled portion which diverges inwardly toward the vertice of the angle formed by the flow regulating portions, extending in that direction a predetermined distance whereupon said second member diverges into generally parallel relation with the direction of movement of the tool along the joint to further define said flow channel.

5. In a tool for effecting the distribution of adhesive, a device according to claim 4 wherein the adhesive supply opening is disposed adjacent the junction of the cavities of the pair of flow regulating portions along the angle vertice defining an adhesive receiving area for accumulation of adhesive prior to distribution to the cavities and to the joint, said first and second members extending at least partially across said adhesive receiving area.

6. In a tool for effecting the distribution of adhesive, a device according to claim 5 wherein the tool includes a threaded bore and further comprising a throughbore and a bolt for insertion through the throughbore into threading engagement with the threaded bore of the tool for securing the device to the tool.

7. A tool for regulating the distribution of adhesive along a taped joint of the type formed by the junction of a pair of converging drywall sections and having a length of tape disposed on the junction comprising:

a pair of flow regulating portions each extending from the vertice of an angle formed between the flow regulating portions and each having a raised surface for distributing and smoothing adhesive along the length of tape during movement of the tool along the joint and an open top cavity recessed laterally inwardly of the raised surface and communicated with the cavity of the other flow regulating portion at the angle vertice;

an opening communicated with both cavities at the angle vertice through which adhesive is supplied contemporaneously with the movement of the tool along the joint, such that the adhesive flows from the supply opening into both cavities and through the open tops of the cavities onto the length of tape; and a device for controlling the flow of adhesive from the tool onto the length of tape including a first member extending at least partially across said supply opening and the open to of one of the cavities for deflecting adhesive flowing laterally from the one cavity through the open top thereof and a second member extending at least partially across said supply opening and the open top of the other cavity for deflecting adhesive flowing laterally out of the other cavity, the first and second members being of a predetermined thickness and defining a flow channel for accumulating and distributing a predetermined volume of the deflected adhesive in a defined flow pattern to the drywall responsive to movement of the tool.

* * * * *

UNITED STATES PATENT AND TRADEMARK OFFICE

CERTIFICATE OF CORRECTION

PATENT NO. : 5,263,836

DATED : November 23, 1993

INVENTOR(S) : Savat Tinawong

It is certified that error appears in the above-identified patent and that said Letters Patent is hereby corrected as shown below:

On the title page: Item [54] and Column 1, line 1, before "TOOL" insert -- IMPROVED --.

Abstract, line 12 (not including heading), delete "cut" and insert therefor -- out --.

Column 2, line 32, after "cavity" delete ",".

Column 4, line 25, after "12" insert -- , --.

Column 5, line 3, after "30A" insert -- , --.

Column 5, lines 32-33, delete "u it" and insert therefor -- unit --.

Column 9, line 9, delete "to" and insert therefor -- top --.

Signed and Sealed this

Sixteenth Day of August, 1994

*Attest:*

*Attesting Officer*

Bruce Lehman

BRUCE LEHMAN

*Commissioner of Patents and Trademarks*